United States Patent [19]

Meyer et al.

[11] 4,052,195

[45] Oct. 4, 1977

[54] METHOD FOR MELTING IRON-CONTAINING MATERIAL

[75] Inventors: Günter Meyer; Dietrich Radke, Essen; Günter Reimann, Essen-Bredeney, all of Germany

[73] Assignee: Fried. Krupp Gesellschaft mit beschrankter Haftung, Essen, Germany

[21] Appl. No.: 701,032

[22] Filed: June 29, 1976

[30] Foreign Application Priority Data

July 2, 1975 Germany ..... 2529391

[51] Int. Cl.[2] ..... C21C 5/52; H05B 7/18

[52] U.S. Cl. ..... 75/10 R; 13/9 ES; 75/12

[58] Field of Search ..... 75/10–12; 13/9

[56] References Cited

U.S. PATENT DOCUMENTS 807,034 12/1905 Von Kugelgen ..... 75/10 R

*Primary Examiner*—Peter D. Rosenberg

*Attorney, Agent, or Firm*—Spencer & Kaye

[57] ABSTRACT

In order to melt iron-containing material, particularly sponge iron, in an electric furnace containing a molten metal mass underlying a molten slag mass, electrodes are immersed in the molten slag mass, a current is caused to flow between the electrodes and is converted into melting heat by the electrical resistance of the slag, and the number of charge carriers in the slag is adjusted to control the conductivity of the slag and thus the ratio of the current flowing through the slag to the current flowing through the molten metal.

8 Claims, No Drawings

METHOD FOR MELTING IRON-CONTAINING MATERIAL

BACKGROUND OF THE INVENTION

The present invention relates to procedures for melting iron-containing material, particularly sponge iron, in a steel-producing process.

In such processes, sponge iron produced by a direct reduction operation is usually melted in an electric arc furnace as a partial substitute for scrap and is then used in the production of steel. Since the grain size of such sponge iron is relatively uniform it can be easily delivered at a controlled rate and is therefore continuously fed into the arc furnace, during a melting period, through one or more openings in the cover of the furnace. The quantity of sponge iron thus fed in is here adapted to the amount of heat provided by the electrical energy being supplied so that all of the sponge iron melts immediately after introduction. In this type of feeding the melting and refining phases take place simultaneously.

In practice, sponge iron constitutes a limited proportion of the total material fed into the electric arc furnace. The furnace is sometimes also supplied with buckets of scrap, i.e. discontinuously. For this purpose electric arc furnaces in which sponge iron is processed are provided with a cover lifting and pivoting mechanism. Heat transfer by radiation which occurs predominantly in electric arc furnaces is advisable if buckets of bulky scrap protect the furnace walls from the radiation. As soon as all of the scrap has been made molten, i.e. during the transition from the melting to the refining phase, the walls are subjected to the greatest thermal stresses.

With continuous feeding in of sponge iron, the walls are subjected to continuous stresses as a result of the radiation heat so that they possess a relatively short lifetime. Moreover, the increased size of the layer of slag as a result of the use of sponge iron does not provide any protection against this radiation from the arc because the slag is ejected by the resulting eccentrically formed plasma stream. The furnace vessel will not be filled completely with all of the material to be melted. Whereas scrap is fed in discontinuously, sponge iron is supplied continuously in quantities per unit time which correspond to the amount of heat derived from the applied electrical energy. Consequently, the furnace contains almost exclusively molten slag and molten metal.

The drawback of this process is the discontinuous charging of the scrap which is necessary, however, inter alia, to protect the walls against excess heat stresses. With continuous melting of sponge iron such protection is not afforded so that the radiation heat subjects the walls to a high degree of wear.

Electric furnaces are known in which the electrodes are immersed into the melt. These furnaces, however, do not serve to melt grainy iron-containing material, particularly sponge iron, but serve to reduce ore mixtures in order to produce iron alloys, achievement of which involves a completely different mode of operation. The ore mixture, or burden, may consist, for example, of ores, slag formers and carbon carriers. The furnace is filled up to its rim with the burden so that a column of this burden is continuously present above the melt. Such a complete filling is necessary in order to achieve a maximum reduction output. The furnace wall in such a process is protected against excess heat stresses by the burden column.

The burden column which in this process is thus absolutely necessary is not subject to bridge formation due to the melting conditions of the burden employed. The physical properties of the bath and the chemical quality of the slag in this process are the inevitable result of the composition of the burden employed. Initially, the electrodes penetrate deeply into the reduction furnace and are completely surrounded by burden up to their upper edges. The object of this process is thus a high reduction output, which is the reason for the presence of the burden column above the melt, and penetration by the electrodes cannot be avoided.

SUMMARY OF THE INVENTION

It is an object of the present invention to melt iron-containing material, particularly sponge iron, while avoiding the above-described drawbacks and while permitting fully continuous operation.

A further object of the invention is to substantially reduce the heat stresses on the furnace walls and to permit monitoring of heat development in the slag during the process.

These and other objects of the invention are achieved by a novel process for melting iron-containing material, particularly sponge iron, in an electric furnace provided with electrodes between which a current flow is established. This process is carried out by immersing the electrodes into the molten slag, passing an electric current between the electrodes so that electrical energy is converted to heat by the effect of the electrical resistance presented by the slag to the flow of current between the electrodes, and varying the concentration of charge carriers in the slag to adjust the electrical conductivity of the slag, thereby to adjust the ratio of current flow through the molten slag to current flow through the underlying molten metal. A significant feature of the invention is that the electrical energy is converted to heat through the action of the resistance presented by the slag. The heat for the process is thus produced in the slag itself and is transferred from the slag to the sponge iron to be melted and to the molten metal. With this type of heat transfer the walls are substantially protected against heat radiation and at the same time the melting output reaches an optimum level.

The present invention takes into consideration the particular properties of sponge iron and the manner in which it is fed to the furnace, compared to scrap. With unchanging, continuous addition of material to be melted, the electrodes are immersed into the slag. It is the object of this process to melt sponge iron or chunks of other iron containing materials which are already present in a reduced form. The reduction work thus moves to the background in favor of the melting and refining work.

A further significant feature of the invention is that a change in the number, or concentration, of charge carriers, or ions, in the slag is used to control the electric conductivity of the slag. This permits adjustment, during the process, of the ratio of current flow through the molten slag to current flow through the molten metal. The conductivity of the slag in the furnace is monitored by a measuring probe.

Thus it is possible to influence the input of heat to the slag in such a way that, during melting of the continuously introduced iron-containing material, on the one hand, the slag has a physically liquid consistency and retains this even if cooling substances are introduced so that further material charges are not prevented from melting and, on the other hand, the degree of overheating of the slag which is in contact with the ceramic furnace lining will not be such as to lead to excessive wear of that lining.

The electrical conductivity of metallurgical slags depends to a great degree on the concentration and mobility of the charge carriers present in the slag, i.e. the composition of the slag is significant for its conductivity. The electrical conductivity of metallurgical slags which may contain, inter alia, CaO, $SiO_2$, $AlO_3$, $TiO_2$, $P_2O_5$, etc., depends to a particular degree on its FeO content. Thus, for example, the electrical resistivity of a slag in the FeO - $SiO_2$ - CaO and FeO - $Al_2O_3$ - CaO systems will decrease with an increase in the FeO content at a particular melting temperature.

The ratio of current flow through the molten slag to current flow through the molten metal is of importance. In order to prevent the majority of the current from flowing through the molten metal bath, it is advisable to maintain at least a minimum distance between the electrodes immersed in the molten slag and the metal bath.

DESCRIPTION OF THE PREFERRED EMBODIMENTS

In preferred embodiments of the invention, the number, or concentration, of charge carriers in the slag is varied by setting the FeO content. Advisably, the FeO content of the slag is set by appropriate adjustment of the $CO/CO_2$ ratio of the gas atmosphere above the slag in the furnace. The iron oxide still present in the sponge iron, depending on the degree of metallization, reacts with the inherently present or added carbon whereby the Bouduard reaction $$CO_2 + C = 2CO$$

lies completely on the side of the CO due to the high melting temperature of more than 1500° C. With a closed furnace the gas atmosphere would consist of 100% CO and, corresponding to the high reduction potential $$P^2co/Pco_2$$

the FeO in the slag would be almost completely reduced.

With a controlled input of air, the reduction potential in the furnace atmosphere can be varied and thus the FeO content of the slag can be set for a given carbon content in the metal.

According to a further advantageous embodiment, the FeO content in the slag is determined by the degree of metallization of the iron-containing material being introduced. It is also possible to use types of sponge iron having various degrees of metallization in a mixture so that the FeO content required to obtain the desired electrical conductivity in the slag develops under a constant furnace atmosphere.

Furthermore, the FeO content of the slag can advantageously be set by the carbon content of molten metal bath, which is influenced by the carbon content of the fed-in sponge iron or by the direct addition of further carbon carriers. Finally, according to a further advantageous embodiment, an adjustment in the degree of basicity of the slag can be used to vary the number of charge carriers in the slag. The degree of basicity is a result of the proportional ratios of the slag components $SiO_2$, $Al_2O_3$ and CaO.

A combination of advantageous embodiments for varying the number of charge carriers in the slag is also possible. The electrical conductivity of the slag is advisably monitored by means of a probe and the results obtained with that probe are used to control the process.

The present invention will now be explained with the aid of a specific example. For melting 100% sponge iron, a slag is used which contains the four components FeO, $SiO_2$, CaO and $Al_2O_3$. The FeO content in the melt is increased in that the gas atmosphere above the melt, which due to the completely sealed furnace and due to the Boudard equilibrium consists of almost 100% CO, has its CO content lowered by the partial introduction of air. The introduction of air is continued until the desired percentage of CO in the gas is obtained as determined by measurement. This means an increase in the oxygen pressure of the $CO_2/CO$ gas mixture and thus a decrease in the reduction capability of the gas mixture. When the FeO content is, as a result of introduction of a suitable quantity of air, increased from 6 to 10% to about 30 to 40%, the conductivity of the slag at 1600° C is increased from 50 to 150 millimhos/cm to 500 to 1500 millimhos/cm. The slag here contains, in addition to FeO, the following components, depending on the composition of the sponge iron charged:

| | | |
|---|---|---|
| $SiO_2$ | : approximately | 47 % to 13 % |
| $Al_2O_3$ | : approximately | 39 % to 32 % |
| CaO | : approximately | 7 % to 3 % |

the remainder consisting essentially of $TiO_2$ and MgO. The conductivity of the molten metal is in the range of $0{,}7 \cdot 10^4$ mhos/cm, the distance between the bottoms of the electrodes and the molten metal has a value of about 1 cm to 100 cm. The voltage is in the range of 40 to 140 V. The slag conductivity can be measured in the furnace and monitored by equipment as stated in the application for german letters patent P 23 28 959.0-35 of June 7, 1973 (DT-OS 23 28 959).

An increase in the content of CaO, similar to an increase in FeO, effects an increase in the conductivity. In order to obtain a satisfactory value of slag conductivity in the range from 500 to 1500 millimhos/cm it is possible with different percentages of CaO to increase or decrease to amount of FeO by the above method according to the measured and monitored conductivity value.

It will be understood that the above description of the present invention is susceptible to various modifications, changes and adaptations, and the same are intended to be comprehended within the meaning and range of equivalents of the appended claims.

What is claimed is:

1. In a method for melting iron-containing material by introducing such material into an electric furnace containing a mass of molten metal and a mass of molten slag floating on the metal and provided with electrodes connected to an electrical power source establishing a potential difference between the electrodes, the improvement wherein the electrodes are immersed in the molten slag so that a flow of electrical current occurs between the electrodes and is converted into heat by the resistance of the slag, and said method comprises adjusting the concentration of free charge carriers in the slag in order to impart a selected electrical conductivity to the slag of between 500 and 1,500 millimhos/cm, thereby to impart a selected value to the ratio of the amplitude of the current flowing exclusively through the molten slag to the amplitude of the current flowing through the molten metal, and the electrodes are immersed into the molten slag such that the distance between the molten metal and the electrodes is between about 1 and 100 cm.

2. Method as defined in claim 1 wherein said step of adjusting the concentration of charge carriers in the slag is carried out by setting the FeO content of the slag to a selected value of charge carriers in the slag.

3. Method as defined in claim 2 wherein the setting of the FeO content of the slag is effected by giving a selected value to the $CO/CO_2$ ratio of the gas atmosphere in the furnace.

4. Method as defined in claim 2 wherein the setting of the FeO content of the slag is effected by giving a selected value to the degree of metallization of the iron-containing material.

5. Method as defined in claim 2 wherein the setting of the FeO content of the slag is effected by giving a selected value to the carbon content of the molten metal.

6. Method as defined in claim 1 wherein said step of adjusting the concentration of charge carriers in the slag is carried out by setting the level of basicity of the slag to a selected value.

7. Method as defined in claim 1 further comprising measuring the electrical conductivity of the slag by means of a probe.

8. A method as defined in claim 1 wherein the iron-containing material is sponge iron.

* * * * *